US005689074A

United States Patent [19]

Penridge

[11] Patent Number: 5,689,074

[45] Date of Patent: Nov. 18, 1997

[54] MUSICAL INSTRUMENT

[76] Inventor: Stanley Penridge, 15100 Hamilton Pool Rd., Austin, Tex. 78738

[21] Appl. No.: 612,184

[22] Filed: Mar. 7, 1996

[51] Int. Cl.[6] ..... G10D 3/02

[52] U.S. Cl. ..... 84/294; 84/267; 84/291

[58] Field of Search ..... 84/291, 294, 295, 84/267

[56] References Cited

U.S. PATENT DOCUMENTS

| | | | |
|---|---|---|---|
| 1,711,386 | 4/1929 | Hey | 84/294 |
| 2,204,150 | 6/1940 | Quattrociocche | 84/267 |
| 2,597,154 | 5/1952 | Maccaferri | 84/267 |
| 3,685,385 | 8/1972 | Rendell | 84/267 |
| 5,052,269 | 10/1991 | Young, Jr. | 84/728 |

*Primary Examiner*—Michael L. Gellner
*Assistant Examiner*—Shih-yung Hsieh
*Attorney, Agent, or Firm*—Andrew M. Hassell

[57] ABSTRACT

Stringed instrument sound modification in which a specially braced soundboard is provided either for stand alone use or in cooperative combination with a plurality of vibrating reeds thereby to modify sounds produced by the vibrating strings of the instrument. The sound board includes an enlarged effective area adapted for reinforced positioning of the instrument bridge, such area being substantially defined by intersections of elements of a pair of x-shaped cross braces. Vibrating reeds are optionally provided in a removable cylindrical array of axially parallel members for further modifying the tonal characteristics of the instrument. This removable cylindrical array is adapted for mounting in the sound hole of a guitar or other stringed instrument.

27 Claims, 4 Drawing Sheets

MUSICAL INSTRUMENT

This invention relates to musical instruments and more particularly to stringed instruments such as guitars.

BACKGROUND OF THE INVENTION

As is known to those skilled in the art, there have been a variety of proposals for producing differing tonal qualities in stringed instruments such as guitars and violins, illustrative of which are the proposals set forth in U.S. Pat. No. 722, 561 granted to Josiah Bunch; U.S. Pat. No. 881,769 granted to John Brown; U.S. Pat. No. 1,539,961 granted to Walter Scott; U.S. Pat. No. 1,700,395 granted to Louis Yukl; U.S. Pat. No. 1,711,386 granted to George Hey; U.S. Pat. No. 2,953,052 granted to Harold Newton; U.S. Pat. No. 3,821, 475 granted to John McKechnie; U.S. Pat. No. 4,024,788 granted to Daniel Dunlap; U.S. Pat. No. 4,394,830 granted to Paul Damiano; U.S. Pat. No. 4,632,003 granted to William Kopp; U.S. Pat. No. 4,649,793 granted to David Blackshear et al.; U.S. Pat. No. 5,438,158 granted to John Riboloff; and British Number 4266 granted Feb. 20, 1907 to Cristobal Murrieta. According to these patents, a variety of proposals have been made for varying tonal qualities and volume through differing constructions and positionings of soundboards, struts, backplates, rosettes, pickguards, bindings, edgings, puffling, supplementary reeds and other auxiliary vibrating and/or sonal-varying elements.

In the acoustic guitar arts, it is known that the soundboard is the element that, next to the strings, exerts the greatest influence on the tonal qualities and intensity of sound produced by the instrument. Within generally recognized limits, the greater the effective area of the soundboard, the greater the intensity of sound produced by the instrument. In addition, the more efficient the soundboard, the more effective it is in modifying or conditioning the acoustic frequencies produced by the vibrating strings.

It has heretofore been proposed to enhance tonal qualities and intensity through employment of selected geometrical relationships between the parts of the guitar frame such as principal surfaces underlying the strings, the struts, backplate, rosette and pickguard on top. Ideally, a sound board should vibrate in a uniform way, with bracing giving structural support and strength. However, since strutting patterns can radically change the sound of a guitar, tradeoffs have heretofore been made to reflect needed limitations on weight, size and strength while presenting acceptable levels of tonal modification and intensity.

Although the proposals of the prior have resulted in acceptable levels of performance, there has remained the need for further improvement.

BRIEF SUMMARY OF THE INVENTION

The improvements according to the invention hereof include physical characteristics which, in cooperative combination, produce improved levels of tonal quality and intensity in hollow body stringed instruments such as guitars. In contrast with prior proposals, an improved system of internal bracing enhances soundboard performance of a basic instrument while an optional insert (replacing the typical rosette) cooperates with the soundboard to further enhance instrument qualities. In the preferred embodiment, a pair of X-shaped braces are provided on the inner surface of the upper top enclosing member. These braces are positioned in a particular relationship so as to present acoustical focal points and produce improved characteristics. Moreover, through the efficacious positioning and orientation of the braces, provision is made for mounting of the bridge over the strongest section in the bracing, thus strengthening the instrument. Additionally, provision is made for the optional utilization of the aforementioned improved optional inserts which, when positioned within the sound hole, provide sound and intensity control without the necessity for electronics.

OBJECTS AND FEATURES OF THE INVENTION

It is one general object of the invention to improve acoustic guitars.

It is another object of the invention to enhance the intensity of sounds produced by acoustic guitars.

It is still another object of the invention to facilitate versatility in tone and intensity control within acoustic guitars.

It is yet another object of the invention to provide for corresponding tonal control in hollow bodied electric guitars.

It is yet another object of the invention to provide flexibility in tone and intensity control through the efficacious use of selectable and adjustable optional inserts.

Accordingly, in accordance with one feature of the invention, there is provided within a hollow bodied guitar, a pair of x-shaped braces in predetermined geometrical interrelationship to increase strength thereby eliminating the need for a conventional rosette, increasing the effective soundboard area and improving tone and intensity.

In accordance with another feature of the invention, such braces are disposed to produce acoustic focal points in predetermined spaced relationship to a sound hole thereby further improving physical and acoustic characteristics.

In accordance with still another feature of the invention, provision is made for optional inclusion of a tone modifying insert for removable mounting within the instrument sound hole.

In accordance with yet another feature of the invention, the aforementioned tone modifying insert may optionally include adjustable acoustic reeds, thereby imparting an increased level of versatility to the instrument.

In accordance with yet another feature of the invention, the optional acoustic reeds of the aforementioned insert are selected to be resonant at different frequencies, thereby providing for additional tonal modification of sounds produced by the instrument.

In accordance with still one further feature of the invention, the annular member is adapted for inclusion within the body of a hollow-bodied instrument or in a recess in an electric stringed instrument, thereby facilitating flexibility and adaptability of use.

These and other objects and features of the invention will be apparent from the following description, by way of example of a preferred embodiment, with reference to the drawing.

DEFINITIONS

As used herein the following definitions are applicable both to the description hereof and the appended claims.

Bridge means a member, usually made of ebony or rosewood, affixed to the instrument soundboard, which holds the saddle on which the tensioned strings rest.

Bridge Pins mean individual fasteners adapted for individually attaching instrument strings to the bridge of the instrument.

Duration means the period of time, or length, during which a tone persists.

Flat Top Guitar means a stringed musical instrument having a sound board the principal part of which underlies the strings and which usually is made of quarter-sawn bookmatched, unblemished straight grained wood. Preferably the material is softwood for its tonal quality: and generally is of spruce, pine or American redwood. It includes ribs, bottom and neck which usually are of matching hardwood.

Intensity means the loudness of acoustical energy produced by an acoustic musical instrument. It represents the energy of the vibrations of the tone substance that is vibrating and the force of the attack.

Pitch means the fundamental frequency, or musical key, to which the instrument is tuned.

Quality means tone quality or timbre.

Resonance means the condition in which a member vibrates sympathically with an activating source of acoustic energy.

Rosette means an annular member surrounding a sound hole on the instrument and providing both decoration and support for the sound hole.

Saddle means a member extending upwardly from the Bridge and adapted for supporting the intermediate portion of the strings of the instrument.

Soundboard means that part of a stringed musical instrument that includes resonating material embodied in the body of the instrument.

Soundhole means an aperture in a Soundboard which communicates the hollow interior of a stringed musical instrument with the exterior and through which a substantial volume of the instrument's acoustic sound is transmitted.

Sweetspot for a hollow bodied guitar means a region on the Soundboard where acoustic energy within the soundboard is maximized and where the instrument bridge is located.

Timbre means the quality given to a sound by its overtones.

DESCRIPTION OF A PREFERRED EMBODIMENT

Figure 1:
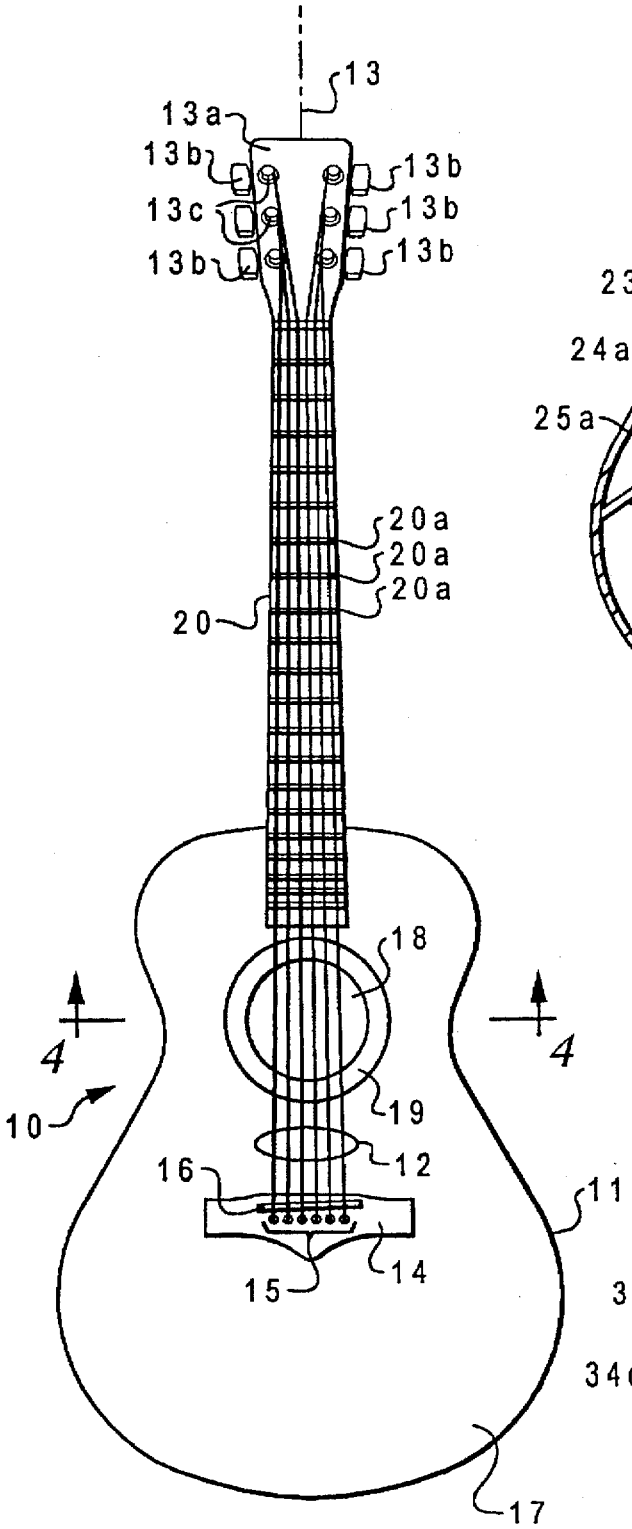
FIG. 1 is a top view illustrating a guitar constructed according to the principles of the invention.

Now turning to the drawing, and more particularly FIG. 1 there, it will be seen that there is therein depicted an acoustic guitar 10 in accordance with the invention. The guitar 10 includes a main hollow body 11 above which there are disposed a plurality of strings 12 which extend longitudinally along the principal axis, or centerline, 13 to conventional tensioning members. Thus, there are shown elongated anchoring and adjustment means extending from the soundboard including an elongated arm 13*a* having a plurality of tension adjusting members 13*b* for individually anchoring first termini 13*c* of the strings 12 and for severally adjusting tensions of strings 12. The remaining ends of the strings 12 are detachably fastened to bridge 14 as by removable bridge pins 15. Affixed to and extending upwardly from bridge 14 is saddle 16 which, as mentioned above, supports the intermediate portion of the strings 12. As is known to those skilled in the art, the top part 17 of the main body 11 of the instrument comprises the major part of the effective soundboard; and therewithin there is provided a conventionally circular sound hole 18 surrounded by a correspondingly circular collar 19 of a removable generally cylindrically shaped sound modifying insert which is depicted in greater detail in FIGS. 4–7. Also affixed to and extending from main body 11 is conventional fingerboard 20 fitted with frets 20*a*.

Figure 2A:
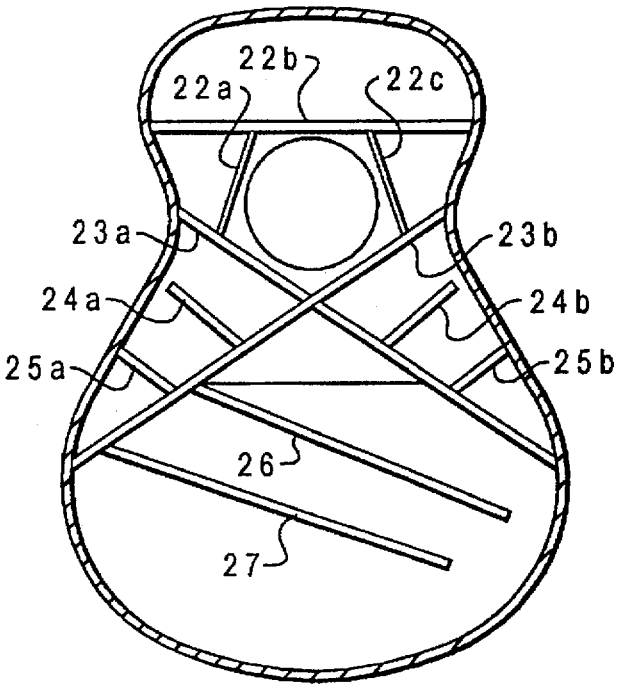
Fig. 2a Prior Art
FIG. 2*a* is an illustration depicting typical soundboard bracing according to popular proposals of the prior art.

Now turning to FIG. 2*a*, it will be seen to depict the underside of the top cover of a first guitar according to the prior art. There, it will be seen are a plurality of bracing members 22*a–c*, an x-shaped brace of members 23*a*–23*b*, stub braces 24*a*–24*b*, reinforcing braces 25*a*–25*b*, and other braces 26–27. Such a configuration has found favor among many guitar makers, particularly in the field of hollow bodied guitars, as representing an acceptable mix of strength and acoustic properties.

Figure 2B:
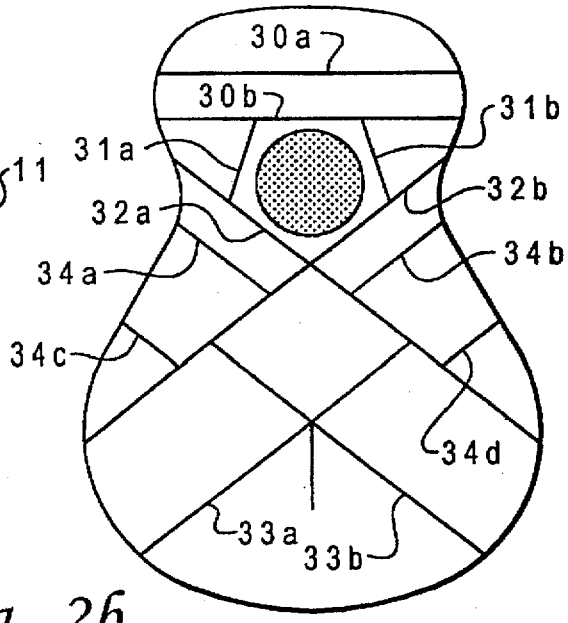
Fig. 2b Prior Art
FIG. 2*b* is an illustration depicting another soundboard bracing arrangement according to the prior art.

Another embodiment of the prior art bracing is depicted in FIG. 2*b* where there are seen upper pairs of braces 30*a*–30*b* and 31*a*–31*b*, an upper cross brace 32*a*–32*b*, lower cross brace 3*a*–33*b*, and intermediate reinforcing braces 34*a*–34*d*. It should be noted that upper x member 32*a* is generally parallel to lower x member 33*b*, while upper x member 32*b* is generally parallel to lower x member 33*a*. Intermediate reinforcing braces 34*a* and 34*c* are generally parallel to x crossing members 32*a* and 33*b*, while braces 34*b* and 34*d* are generally parallel to x crossing members 32*b* and 33*a*. Such geometrical configuration has found favor among some acoustic guitar makers as representing a desirable mix of strength and acoustic properties.

Figure 3:
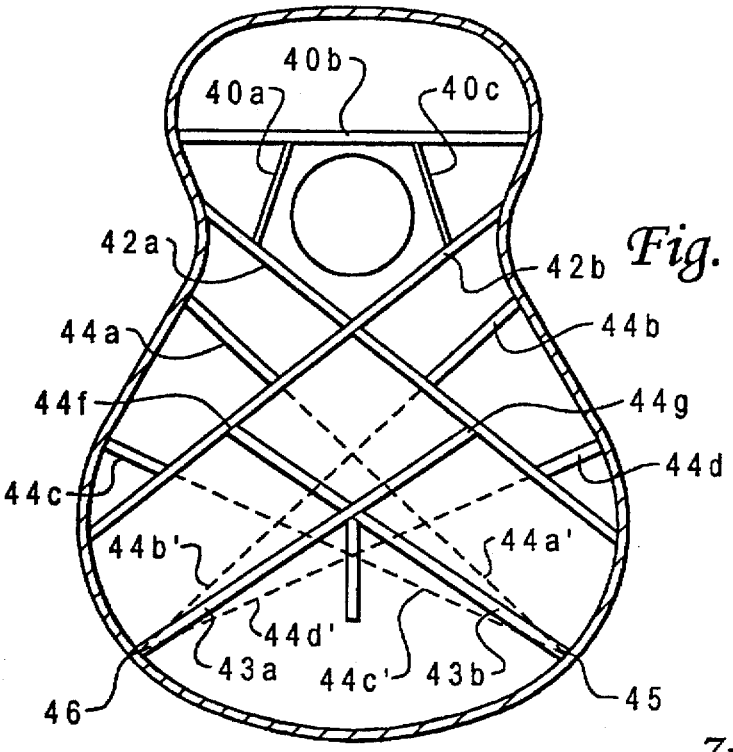
FIG. 3 is an illustration depicting the double X-shaped spaced bracing according to the invention and showing geometrical positioning and orientation of selected bracing members to focus acoustic energy.

FIG. 3 illustrates the underside of a sound board constructed in accordance with the principles of the invention. As will be observed there, certain of the bracing members have intentionally been disposed in non-parallel configurations so as to focus acoustic energy and impart important improvements in tonal quality and control. There, it will be observed are thin strip members 40*a*–40*c* which generally correspond to members 22*a*–22*c* of FIG. 2*a*, members 42*a*–42*b* which generally correspond to members 32*a*–32*b* of FIG. 2*b*, 43*a*–43*b* which generally correspond to members 33*a*–33*b* of FIG. 2*b*, and members 44*a*–44*c* which generally correspond to members 34*a*–34*c* of FIG. 2*b*. However, in dramatic contrast with the geometries of FIG. 2*b*, the axial orientation of members 44*a*–44*d* as represented by extending dashed lines 44*a'*–44*d'* is such that dashed lines 44*a'* and 44*c'* converge to form an apex (acoustic energy focal point) at a location 45 at the lower side of the guitar, whereas dashed lines 44*b'* and 44*d'* converge to form a similar apex (acoustic energy focal point) at a location 46 in symmetrical relationship to the center line of the instrument. It will also be observed that lower x crossing member 43*a* essentially bisects the acute angle formed at location 46 between dashed lines 44*b'* and 44*d'*; whereas member 43*b* essentially bisects the acute angle formed at location 45 between dashed lines 44*a'* and 44*c'*. By thus focusing acoustic energy produced within the soundboard, several unexpected and improved results occur: (1) the acoustic intensity of sound produced by the instrument is increased; (2) the simulated or effective tonal-affecting region of the sound board is increased; and (3) the timbre and other tonal qualities are correspondingly improved. In addition, it has been found desirable to mount the instrument bridge so that its ends overlie the points 44*f* and 44*g* respectively, thus providing mounting at particularly strong points over the bracing.

Although the foregoing principles of energy focusing may be applied with a range of locations for acoustic energy focusing points 45 and 46, it has been found that preferred parameters in wooden acoustic guitars of conventional sizes are as follows: (1) the distance between focusing points 45 and 46 approximates 5 to 6 inches; and (2) acute angles formed by lines corresponding to pairs of dashed lines 44*a'*/44*c'* and 44*b'*/44*d'* approximate 20 degrees. In this connection, however, it should be noted that the optimal parameters are correlated with the overall size of the instrument, the type and thickness of wood from which the instrument body is made, the type of wood and the sizes of the bracing members, and the characteristics of the optional removable reed array insert described below.

Figure 6:
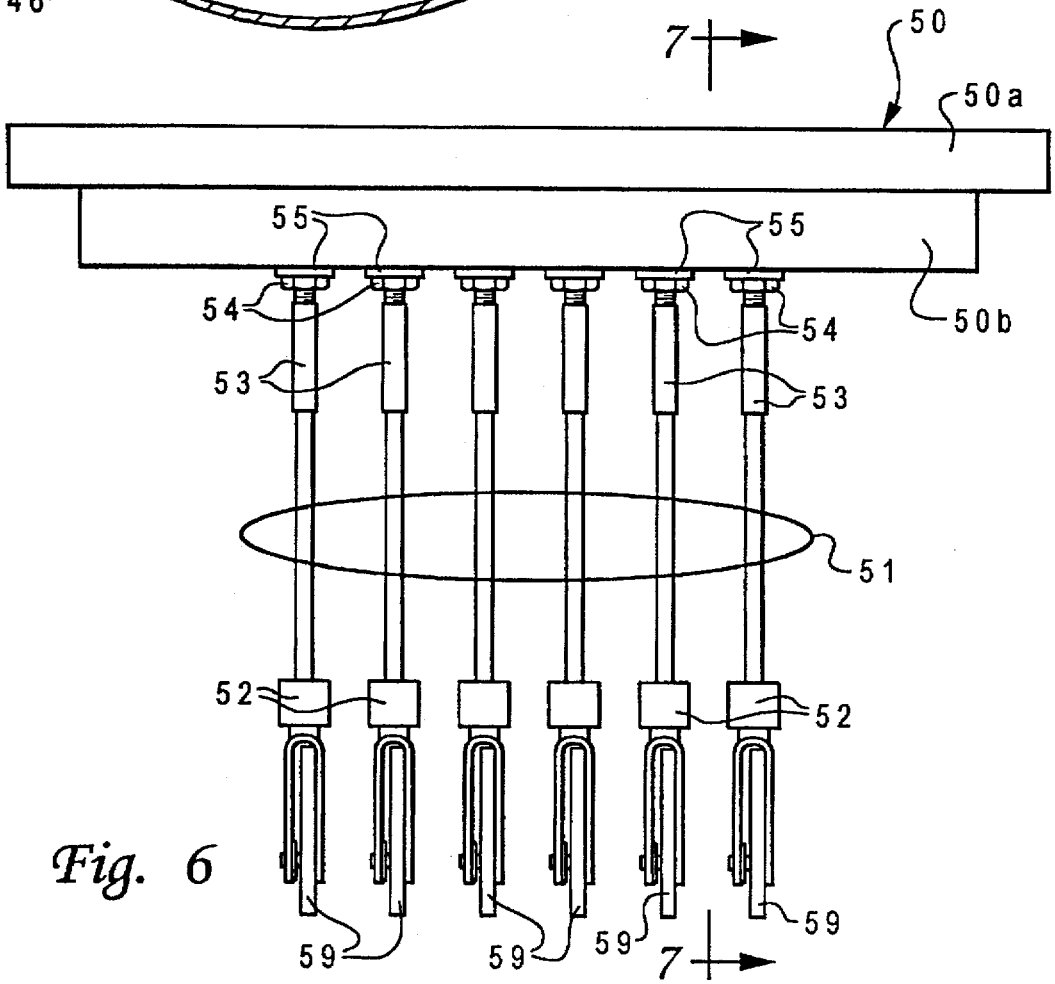
FIG. 6 is a view depicting one of the optional removable inserts when separated from the guitar.
Figure 4:
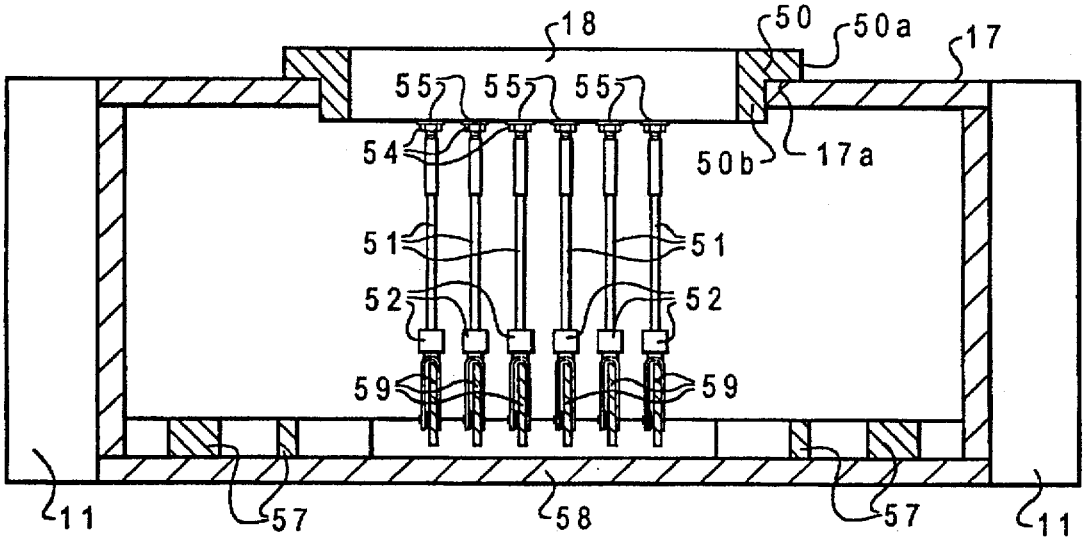
FIG. 4 is a section taken through the sound hole of the guitar of FIG. 1 and depicting an optional removable insert in place therewithin.
Figure 7:
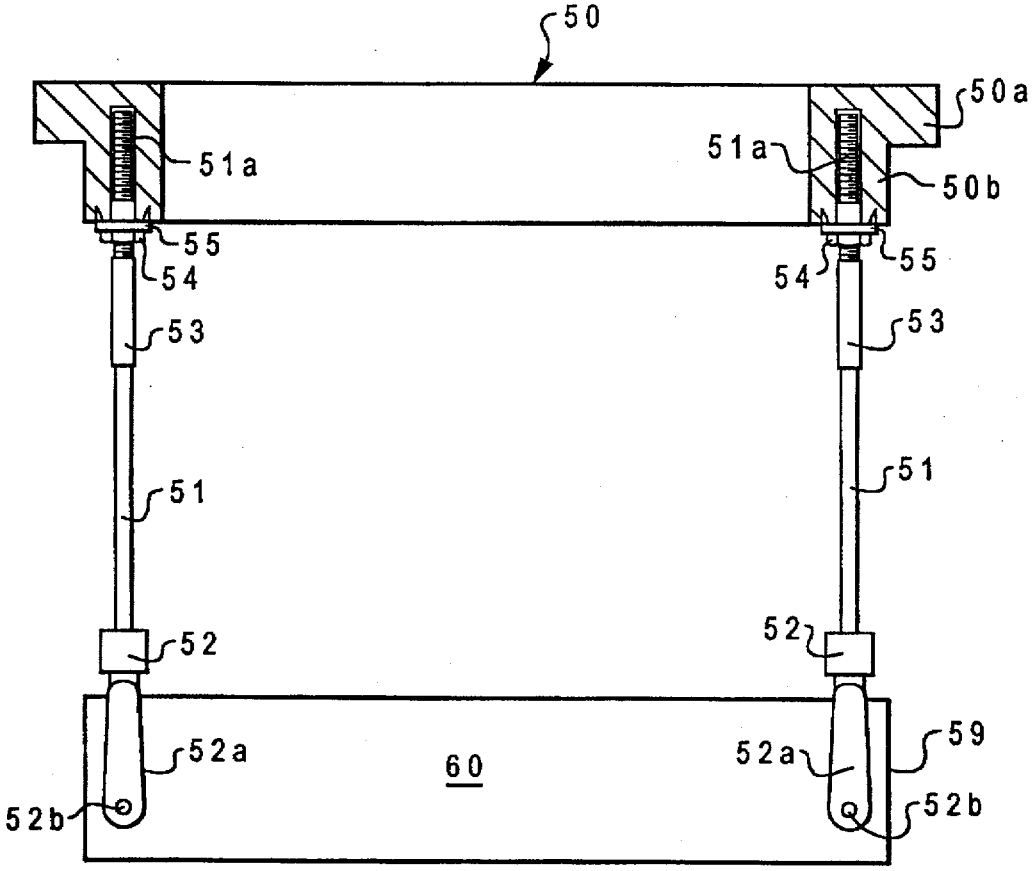
FIG. 7 is a section taken along section lines 7—7 of FIG. 6.
Figure 5:
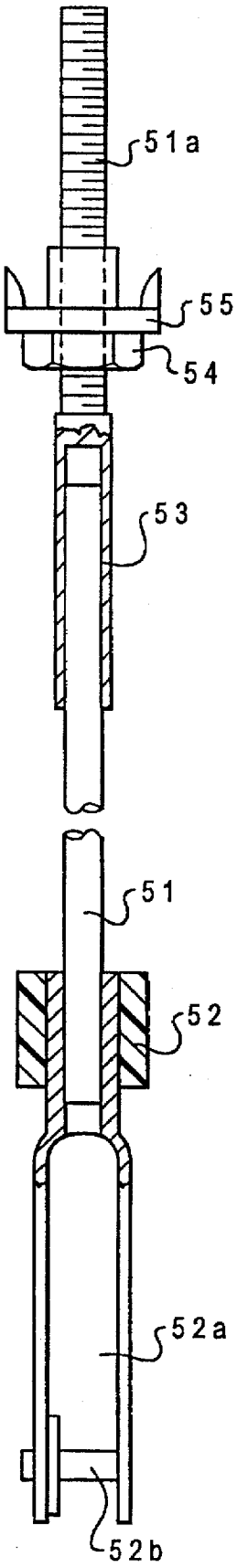
FIG. 5 is a detail depicting one of the optional vibrating reed members of FIG. 4.

Now turning to FIG. 4 it will be seen to be a section taken along section lines 4—4 through the sound hole of the acoustic guitar of FIG. 1 and depicting an optional removable insert in place therewithin. There, it will be seen are the soundhole together with one half of the aforementioned circular donut-shaped removable insert body 50 which includes collar part, or circular lip, 50*a* in contact with a corresponding circular region 17*a* on guitar body top 17. Depending downwardly from collar part, or lip, 50*a* is cylindrically-shaped extension 50*b* which is slightly tapered so as to friction fit snugly within a corresponding aperture (sound hole) in body top 17. Affixed to extension 50*b* and depending downwardly therefrom are a plurality of elongated rods 51 preferably (but not necessarily) made of brass as shown in greater detail in FIGS. 5–7. These rods preferably are about 1/16th inches in diameter, are adjustable in length and extend for about 2.5 to 3.5 inches between clips 52 and shanks 53. The extending ends 51*a* (FIG. 5) are threaded at their upper extremities so as to mate with corresponding female threads provided in jamb nuts 54 and threaded female supports 55 (FIGS. 5–7). To adjust the effective lengths (and therefore the acoustic resonant frequencies) of the rods, the jamb nuts 54 are loosened and the rods 51 are screwed in or out of threaded female supports 55 after which the jamb nuts 54 are tightened to retain the adjustment.

Also shown in FIG. 4 are representative bracing members 57 for the bottom 58 of the main guitar body 11, as well as ends 59 of horizontally extending wooden reeds 60 (FIGS. 6 and 7).

Before proceeding to FIG. 5, it may be helpful to have in mind that, as mentioned above, the foregoing removable insert may comprise portions 50, 50*a* and 50*b* only if the degree of tonal modification desired is less than that provided by inclusion of the elongated rods 51 and vibrating reed members 80. Members 50, 50*a* and 50*b* may be made of woods of differing density to impart differing tonal modifications. Thus, in accordance with the preferred embodiment hereof, soft, mid-range and hard woods may be employed to customize tonal modification. Examples of such woods are, for soft woods, pine and cedar, for mid-range, mahogony and poplar, and for dense woods, walnut and maple. Those skilled in these arts will recognize that the denser the wood, the less it tends to vibrate. Thus, dense wood tends to produce a higher timbre, soft wood a warmer quality (more bass).

In FIG. 5, one of the foregoing vertically depending vibrating assemblies is shown in detail. There, it will be seen is reed-holding clip 52 which includes a u-shaped projection 52*a* adapted for receiving one end of a vibrator reed 60 (FIG. 7). At the lower part of projection 52*a* is positioned a fastener 52*b* which snugs up the ends of u-shaped projection to hold the vibrator reed in place. At the upper part of the assembly there is seen the aforementioned shank portion 53 and threaded rod extension 51*a* projecting through jamb nut 54 and threaded female support 55 as described above.

As mentioned above, FIG. 6 is a view depicting the optional removable insert when separated from the guitar. The elements of FIG. 6 are described above in connection with the description of FIG. 4, FIG. 4 in essence corresponding to a section taken through FIG. 6 while mounted within the main body 11 of the guitar. Thus, there are described insert body 50 which includes collar part, or circular lip, 50*a*. Depending downwardly from collar part, or lip, 50*a* is cylindrically-shaped extension 50*b* which is slightly tapered so as to friction fit snugly within a corresponding aperture (sound hole) in body top 17, thereby adapting it for easy rotational adjustment to correspondingly vary its tone-modifying characteristics when mounted with the guitar body. Affixed to extension 50*b* and depending downwardly therefrom are the plurality of elongated rods 51 preferably (but not necessarily) made of brass, the clips 52 and shanks 53. Also shown are the jamb nuts 54 and the female supports 55. Also shown in FIG. 6 are ends 59 of horizontally extending wooden reeds 60 (FIG. 7).

As mentioned above, FIG. 7 is a section taken along section lines 7—7 of FIG. 6 and thus shows the vibrating reed member 60 extending between opposite vibrating rods 50. As will be evident from reference again to FIGS. 4 and 6, in the preferred embodiment there are a total of twice as many rods 51 as there are strings 12; thus, for a guitar with six strings, there are provided a total of 12 rods 51 and six reeds 60. Accordingly, there is one vibrating assembly comprising two rods 51 and one reed 60 for each of the strings of the instrument; and thus, a separate tonal modification maw be provided and separately tuned for each string. It should, however, be noted that tonal modification may be made for selected strings only, in which event, a lesser effective number of vibrating assemblies would be included. It should also be noted that additional reeds of different wood may be provided to customize tonal qualities.

As mentioned above, the removable inserts may be advantageously employed with stringed instruments other than acoustic guitars. Thus, for example, the principles may be advantageously employed with various hollow bodied instruments, including flat top, arch top and thin line guitars.

Although the foregoing acoustic focusing, as provided in the embodiment of FIG. 3 by the non-parallel bracing, provides a new and unexpected result by enhancing sound intensity, enlarging the operationally effective region of the soundboard, and improving tonal quality while at the same time facilitating a location of greater structural strength for positioning an instrument bridge, still greater advantages are optionally achievable when the optional cylindrical insert of FIGS. 4–7 is installed within the instrument sound hole. There, an insert with reeds may be positioned so that its reeds 60 are in axial alignment with the axis of the strings (e.g., strings 12) to provide maximum effective tonal modification. Or, the insert may be rotated slightly so that the axes of reeds 60 are at an angle to those of the strings 12, so as to affect the tonal modification. As mentioned above, the slightly tapered mating surface of collar **50*b*** provides for friction fit and corresponding ease of insert rotation.

In addition to tonal modification available through adjustment of the insert, additional adjustment is available through provision for individually adjusting the effective length of vibrating rods 51. Thus, although as mentioned above it is contemplated that pairs of rods and their bridging reeds would be individually tuned, each pair to a different one of the instrument strings, by slightly raising or lowering the rods and reeds, additional tonal modification may be achieved so as to result in timbre most pleasing to the individual ear.

It will now be evident that there has been described herein improved stringed musical instruments that provide increased versatility and attractiveness.

Although the inventions hereof have been described by way of preferred embodiments, it will be evident that other adaptations and modifications may be employed without departing from the spirit and scope thereof. Thus, for example, yet a different type of hollow-bodied stringed instrument (e.g., large instruments such as an upstanding bass) could be employed while practicing the principles of the invention.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. An acoustic modification member for a stringed musical instrument comprising:

(a) an annular supporting member, said annular supporting member having an upper surface lying essentially in a first plane and a central axis normal to said first plane;

(b) a plurality of elongated acoustically vibratable members each having an elongated axis substantially parallel to said central axis; and (c) attachment means including affixing means for interconnecting an end of each of said elongated acoustically vibratable members to said annular supporting member thereby to dispose said elongated acoustically vibratable members in a spaced array.

2. An acoustic modification member according to claim 1 wherein said elongated acoustically vibratable members are each acoustically resonant at a frequency different from those of others of said elongated acoustically vibratable members.

3. An acoustic modification member according to claim 1 wherein said elongated acoustically vibratable members are each acoustically resonant at a frequency different from those of all of the others of said elongated acoustically vibratable members.

4. An acoustic modification member according to claim 1 further including means for disposing said elongated acoustically vibratable members in operative pairs.

5. An acoustic modification member according to claim 4 wherein each of said operative pairs is resonant at a frequency different from those of others of said pairs.

6. An acoustic modification member according to claim 4 wherein said means for disposing said elongated acoustically vibratable members in operative pairs comprises a plurality of elongated reed members each connected to ends of pairs of said elongated acoustically vibratable members.

7. An acoustic modification member according to claim 6 wherein said elongated reed members are principally of wood.

8. An acoustic modification member according to claim 6 wherein said elongated acoustically vibratable members include clips for attaching and supporting said elongated reed members.

9. An acoustic modification member according to claim 6 wherein there is included one of said elongated reed members for each string of said stringed musical instrument.

10. An acoustic modification member according to claim 1 wherein said elongated acoustically vibratable members include elongated shafts and wherein said elongated shafts are of brass.

11. In combination, a stringed musical instrument comprising:

(a) a sound board having an aperture therein, said sound board having a principal upper surface and a principal lower surface parallel to said principal upper surface;

(b) means including a plurality of strings for producing acoustic sounds in response to activation thereof, each of strings having a first terminus at one end and a second terminus ad the remaining end;

(c) elongated anchoring and adjustment means extending from said sound board including an elongated arm having a plurality of tension adjusting members for individually anchoring first termini of said strings and for severally adjusting tensions of said strings;

(d) other anchoring means for anchoring said second termini of said strings thereby to cause said strings to pass adjacent said sound board;

(e) and reinforcing means affixed to said principal lower surface, said reinforcing means including:

(i) a first pair of transversely disposed members forming a first cross, and (ii) a second pair of transversely disposed members forming a second cross, said first cross and said second cross being displaced laterally from each other along an axis parallel to axes of said strings; and (f) An acoustic modification member mounted within said aperture of said sound board, said acoustic modification member including:

(i) an annular supporting member, said annular supporting member having an upper surface lying essentially in said first plane and a central axis normal to said first plane;

(ii) a plurality of elongated vibratable members each having an elongated axis substantially parallel to said central axis; and (iii) attachment means including affixing means for attaching an end of each of said elongated vibratable members to said annular supporting member thereby to dispose said vibratable members in a spaced array.

12. A stringed musical instrument according to claim 11 wherein said stringed musical instrument is hollow-bodied.

13. A stringed musical instrument according to claim 12 wherein said stringed musical instrument is an acoustic guitar.

14. A stringed musical instrument according to claim 11 wherein said sound board is on the top side of said instrument underlying said strings.

15. A stringed musical instrument according to claim 11 wherein said aperture is a sound hole.

16. A stringed musical instrument according to claim 11 wherein said aperture is circular.

17. A stringed musical instrument according to claim 11 wherein said means for focusing acoustic energy produced within said sound board includes means for focusing said acoustic energy at a first location at one side of said sound board and at a second location at another side of said sound board.

18. A stringed musical instrument according to claim 11 wherein said first cross and said second cross define a diamond-shaped region of said soundboard therebetween and wherein a bridge for supporting strings of said instrument has two ends, one of said ends being positioned over one point of convergence of sides of said diamond-shaped region and the other of said ends being positioned over an opposite point of convergence of sides of said diamond-shaped region.

19. A stringed musical instrument according to claim 11 wherein said elongated acoustically vibratable members are each acoustically resonant at a frequency different from those of others of said elongated acoustically vibratable members.

20. A stringed musical instrument according to claim 11 further including means for disposing said elongated acoustically vibratable members in operative pairs.

21. A stringed musical instrument according to claim 20 wherein each of said operative pairs is resonant at a frequency different from those of others of said pairs.

22. A stringed musical instrument according to claim 20 wherein said means for disposing said elongated acoustically vibratable members in operative pairs comprises a plurality of elongated reed members each connected to ends of pairs of said elongated acoustically vibratable members.

23. A stringed musical instrument according to claim 22 wherein said elongated reed members are principally of wood.

24. A stringed musical instrument according to claim 22 wherein said elongated acoustically vibratable members include clips for attaching and supporting said elongated reed members.

25. A stringed musical instrument according to claim 22 wherein there is included one of said elongated reed members for each string of said stringed musical instrument.

26. A stringed musical instrument according to claim 22 further including adjusting means for adjusting distance between said elongated reed members and said plurality of strings.

27. A stringed musical instrument according to claim 11 wherein said elongated acoustically vibratable members include elongated shafts and wherein said elongated shafts are of brass.

* * * * *